US005672207A

United States Patent [19]

Oechler

[11] Patent Number: 5,672,207

[45] Date of Patent: Sep. 30, 1997

[54] APPARATUS FOR APPLICATION OF A COLOR COAT TO A WORKPIECE

[75] Inventor: Horst-Dieter Oechler, Lemgo, Germany

[73] Assignee: Firma Theodor Hymmen, Bielefeld, Germany

[21] Appl. No.: 547,101

[22] Filed: Oct. 23, 1995

[30] Foreign Application Priority Data

May 22, 1995 [DE] Germany ..... 295 08 265 U

[51] Int. Cl.[6] ..... B05C 1/00

[52] U.S. Cl. ..... 118/681; 118/686; 118/696; 118/704; 118/705; 118/35; 118/641; 118/58; 118/66; 118/238; 118/241; 118/244; 118/258

[58] Field of Search ..... 118/681, 663, 118/686, 687, 696, 704, 705, 35, 40, 641, 58, 66, 236, 238, 241, 244, 258, DIG. 9; 156/556, 558, 559, 563, 578; 198/599, 600, 607, 621.2, 346.2, 347.2, 606, 608

[56] References Cited

U.S. PATENT DOCUMENTS

| | | | |
|---|---|---|---|
| 3,895,126 | 7/1975 | Strauss et al. | 118/66 |
| 3,902,453 | 9/1975 | Frische | 118/322 |
| 4,484,537 | 11/1984 | Kerber | 118/236 |
| 4,949,665 | 8/1990 | Weber | 118/322 |
| 5,221,347 | 6/1993 | Heine | 118/322 |
| 5,401,531 | 3/1995 | Faraoni et al. | 118/686 |
| 5,443,643 | 8/1995 | Cardini et al. | 118/687 |

*Primary Examiner*—Laura Edwards
*Attorney, Agent, or Firm*—Henry M. Feiereisen

[57] ABSTRACT

An apparatus for color coating and further manipulating workpieces of wood, plastic material or metal includes a color coating station and further product-manipulation stations for finishing the workpiece. Through provision of a conveyor, the workpiece shuttles through the color coating unit and the manipulation stations at least in one forward run and at least in one return run, whereby a control unit moves the color coating unit and the manipulation stations commensurate with a preselected program between an operating position and an idle position during forward run and return run of the workpiece.

26 Claims, 4 Drawing Sheets

APPARATUS FOR APPLICATION OF A COLOR COAT TO A WORKPIECE

BACKGROUND OF THE INVENTION

The present invention refers to an apparatus for color coating and further manipulating a workpiece made of e.g. wood, plastic material or metal.

In conventional enameling plants, the workpiece is transported from a receiving end to a discharge end through various priming stations, one or more color coating stations and further product manipulation stations for finishing the workpiece. The program sequence for processing the workpiece depends on the sequentially positioned stations between the receiving end and the discharge end.

In general, color coating plants have great length and incur high initial costs which render their use in small businesses unlikely.

SUMMARY OF THE INVENTION

It is an object of the present invention to provide an improved apparatus for color coating and further manipulating a workpiece, obviating the afore-stated drawbacks.

It is a further object of the present invention to provide an improved apparatus for color coating and further manipulating a workpiece, that allows processing of various workpieces by suitably adjusting the program sequence of processing steps.

It is still another object of the present invention to provide an improved apparatus for color coating and further manipulating a workpiece, that is of small dimensions to allow its application for small businesses.

These objects and others which will become apparent hereinafter are attained in accordance with the present invention by shuttling the workpiece by means of one or more conveyors through various workpiece manipulation stations at least in one forward run and at least in one return run, and by controlling the manipulation stations commensurate with a preselected program between an operational position and an idle position during the forward run and the return run.

By controlling the operation of the stations and by shuttling the workpiece back and forth through the various stations, the program sequence can be best suited in an easy and cost-efficient manner to the desired treatment of the workpiece as the stations can alternate between the operational position and the idle position during passage of the workpiece. Until completion of the end product, the workpiece can shuttle repeatedly through the apparatus, optionally even at different speeds. Thus, even a small number of processing stations affords a great versatility of the overall apparatus as many programs can be selected for manipulating the workpiece.

Suitably, the receiving end, i.e. the loading location where the workpiece enters the apparatus and the discharge end, i.e. the location where the end product is removed, coincide with each other so that the operation of the apparatus can be handled by a single operator.

Shuttling of the workpiece through the individual stations may be effected by a conveyor system in form of individual conveyor tables that are respectively assigned to the stations and operated in unison by a common control unit to regulate their operating (conveying) direction and operating (conveying) speed. Each table includes a plurality of successively arranged rollers which are driven by a suitable drive mechanism that is actuated by the control unit.

Suitably, the tables of successive stations extend in alignment to each other to facilitate the advance of the workpiece.

In order to economize the operation of the apparatus, a lifting device in form of projecting spaced spikes is positioned at the receiving end to cooperate with the respective table, with the spikes being movable between a lower position in which the spikes extend between the rollers of the table and an upper position in which the spikes are ready for receiving a further workpiece. Thus, while one workpiece is advanced through the apparatus, the spikes are elevated to the upper position to receive a second workpiece for subsequent processing.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
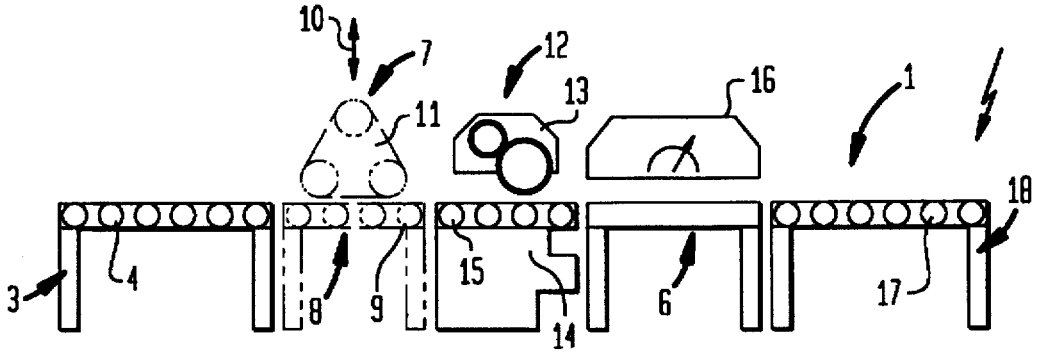
FIG. 1 shows a schematic, simplified illustration of an apparatus for manipulating a workpiece in various sequentially arranged stations, in accordance with the present invention.

Throughout all the Figures, the same or corresponding elements are generally indicated by the same reference numerals.

Turning now to the drawing, and in particular to FIG. 1, there is shown a schematic, simplified illustration of an apparatus, generally designated by reference numeral 1, for color coating and further manipulating a workpiece 2 that can be made of wood, plastic material or metal. The apparatus 1 is provided at its loading location or receiving end with a table 3 that has rollers 4 driven by a suitable drive mechanism (not shown) for transporting the workpiece 2. Cooperating with the table 3 is a lifting device in form of vertically adjustable spikes 5. As shown in FIGS. 6.1 to 6.4, the spikes 5 are movable by a suitable motor (not shown) between a lower position in which the spikes 5 are positioned between the rollers 4 of the table 3 as shown in FIG. 6.1 and an upper position in which the spikes 5 extend above the table 3 (FIG. 6.2) for receiving a second workpiece 2.1, as shown in FIG. 6.3. The lifting device may be of any suitable type to enable a positioning of the spikes 5 between the rollers 4 and their elevation to a level above the table 4.

Positioned next to the table 3 is a manipulation station in form of a machining unit, grinding unit, generally designated by reference numeral 7 and including a conveyor table 8 that is in alignment with the table 3 and includes driven rollers 9. The grinding unit 7 is equipped with a grinder 11 which is vertically adjustable as shown by double arrow 10 for movement between an operational position as well as an idle position.

Following the grinding unit 7 is a color coating station, generally designated by reference numeral 12 and including a coating aggregate 13 with an applicator drum for applying a coat of paint. The coating station 12 includes a conveyor table 14 which is in alignment with the previous tables 3 and 8 and provided with rollers 15 that are driven by the drive mechanism for advancing the workpiece 2.

It will be appreciated by persons skilled in the art that grinding units and color coating units of this type are generally known so that a detailed description thereof is omitted for sake of simplicity.

In case the coating aggregate 13 is provided with an applicator drum for applying the coat of paint through contact upon the workpiece 2, the coating aggregate 13 can also be moved in vertical direction between an operational position and an idle position.

Following the color coating station 12 is a further manipulation station 16 which represents a dryer with one or more radiators by which the paint applied upon the workpiece 2 is dried and the curing action can be accelerated. The dryer 16 is also provided with a conveyor table 6 for advancing the workpiece 2.

Following the dryer 16 is a discharge table 18 which is provided with driven conveyor rollers 17 and form an evaporation zone.

Figure 7:
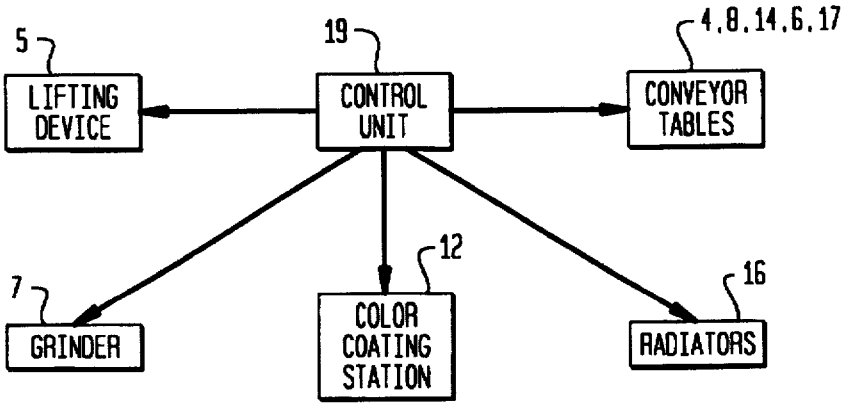
FIG. 7 is a schematic block diagram showing cooperation between various elements of the apparatus according to the present invention.

As shown in FIG. 7, the operation of the stations 10, 12, 16 and the operation of the conveyor tables 3, 8, 14, 6, 18, i.e. the drive mechanism for the rollers 4, 9, 15, 17, are controlled by a control unit 19. As will be described furtherbelow, the conveyor tables 4, 6, 8, 17 can be operated by the control unit 19 in unison at different speeds and to change their conveying direction so as to maximize the effectiveness of the stations and to adjust the program sequence in dependence of the desired end product.

At operation, the workpiece 2 is transferred from a preparatory table 20 in from of a scissors-type jack onto the table 3 for transport in a forward run through the various stations until reaching the discharge table 18. Subsequently, the control unit 19 reverses the conveying direction of the tables 3, 8, 14, 6, 18 to shuttle back the workpiece 2 in a return run from the discharge table 18 to the table 3. In accordance with a preselected program as controlled by the control unit 19, the individual manipulation stations 10, 12, 16 can be moved between an operational position and an idle position.

Figure 1A:
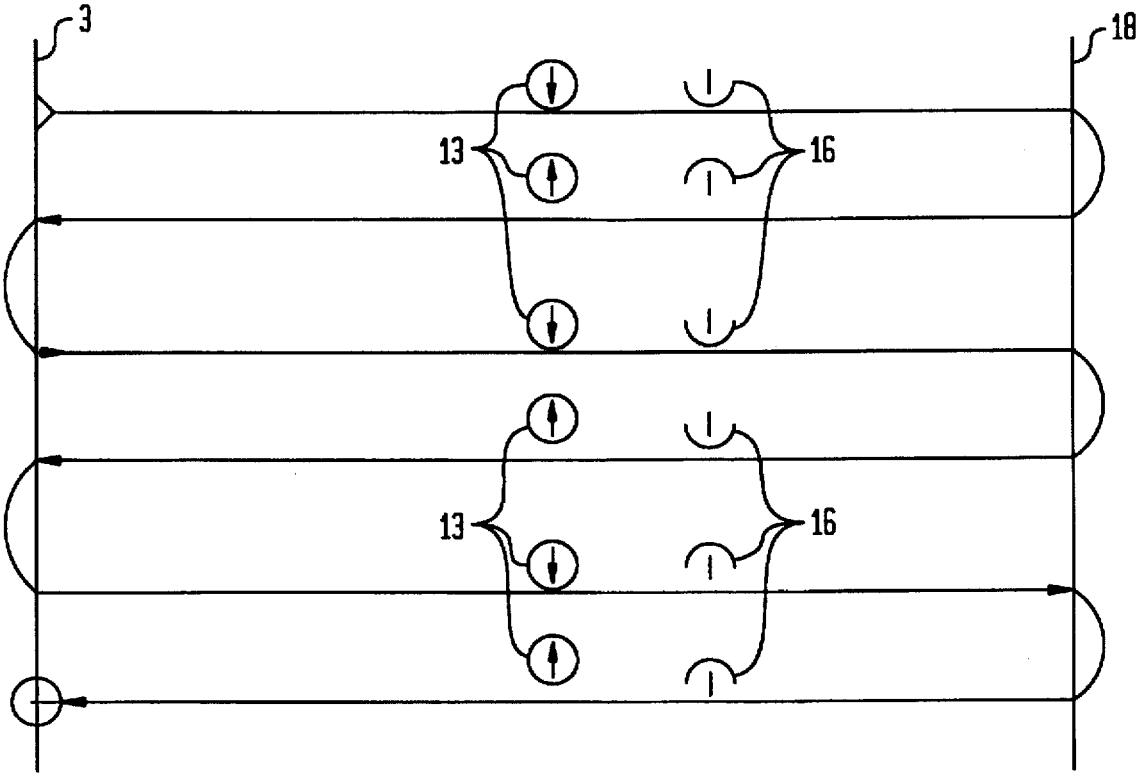
FIG. 1*a* is a schematic illustration of a first example of a program sequence for manipulating a workpiece.

Turning now to FIG. 1*a*, there is shown a first example of a suitable program sequence for processing a workpiece 2, utilizing only the color coating station 12 and the dryer 16 while the grinding unit 7 is idle. After being transferred onto the table 3, the workpiece 2 is moved by the conveyor rollers 4 at a first lower speed in direction of the discharge table 18. During this first forward run, the workpiece 2 enters the color coating station 12 for applying a coat of paint to form a primer. After passage of the idle dryer 16 and reaching the discharge table 18, the workpiece 2 is shuttled back at a second higher speed, e.g. a speed twice the first speed. During the first return run, only the dryer 16 is operational to effect a drying of the applied primer. After reaching the table 3, the control unit 19 reverses the conveying direction and slows the conveying speed. The workpiece 2 is advanced in a second forward run to the color coating station 12 for applying a coat of paint upon the primer. The dryer 16 is idle. After reaching the discharge table 18, the workpiece 2 is shuttled back at the higher second speed, with the dryer 16 and the color coating station 12 now being idle. Following the second return run is a third forward run at the first slower speed for applying a further coat of paint in station 12. Subsequently, the workpiece 2 moves past the dryer 16 which is on to intensify the drying action of the applied coat of paint. When the workpiece 2 shuttles back, the drying process is continued during the third return run by the dryer 16, with the color coating station 12 still being idle.

The program sequence as shown in FIG. 1*a* results in a primed workpiece 2 with two coats of paint, whereby the end product is removed from the receiving table 3. Thus, the entire operation of the apparatus can be performed by a single person as the receiving end and the discharge end coincide at the same end.

Figure 2:
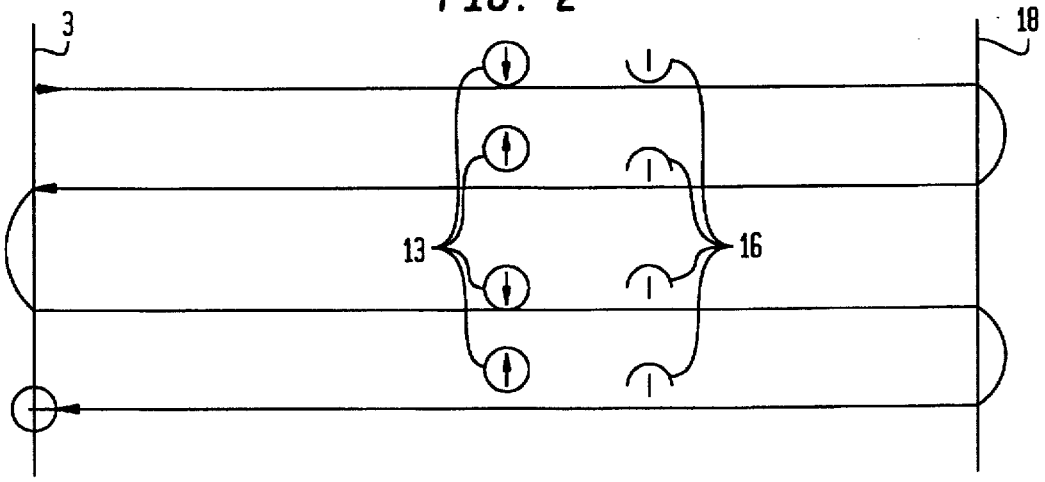
FIGS. 2 to 5 show further schematic illustrations of program sequences for manipulating a workpiece.

Turning now to FIG. 2, there is shown a modified program sequence in which the workpiece 2 shuttles back and forth in two cycles. During the forward run of the first cycle, the workpiece 2 is conveyed at the lower first speed and applied with a coat of paint in the station 12. The dryer 16 is idle. After reaching the table 18, the conveying direction of the tables is reversed and the conveying speed increased for advancing the workpiece 2 at the higher second speed past the operational dryer 16 for drying the applied coat of paint while the coating station 12 is now idle. The second forward run is again effected at the slower speed, with the color coating station 12 being operational for applying a second coat of paint onto the workpiece 2. Also the dryer 16 is operational to intensify the drying process of the applied coat. Drying is continued during the second return run while the workpiece 2 is transported at the lower speed, with the color coating station 12 being idle. Also after running through this program sequence, the end product can be removed at the receiving end.

Figure 3:
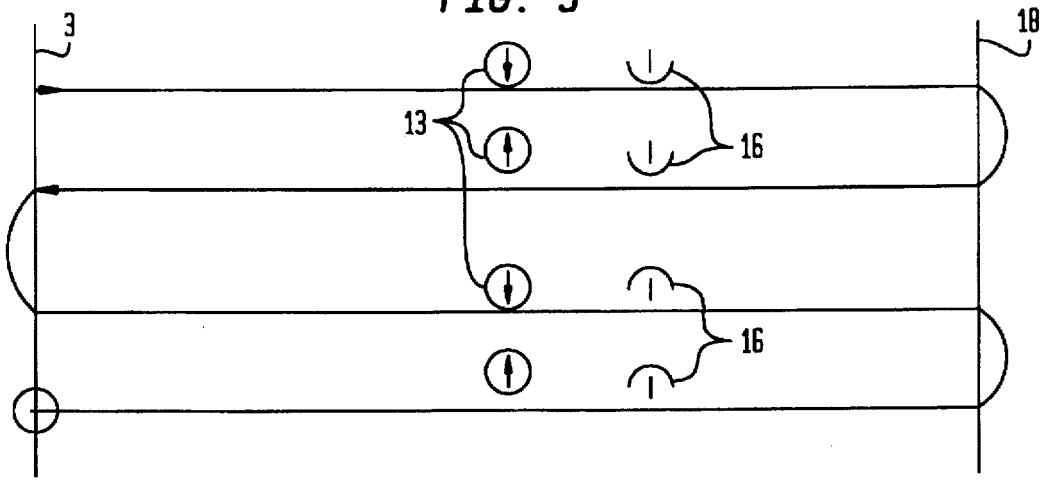

The program sequence according to FIG. 3 includes also two cycles, whereby in a first forward run at lower speed, the station 12 applies a coat of paint upon the workpiece 2. The dryer 16 is idle. The first return flow is effected at a higher speed, with station 12 and dryer 16 being idle. During the second forward run, a second coat of paint is applied on the primer in the station 12 and subsequently subjected to drying by the dryer 16. During subsequent shuttling back, the conveying speed is slowed again to allow appropriate drying by the dryer 16. The end product 2 can be removed at the receiving end 3 and includes a primer and a coat of paint.

Figure 4:
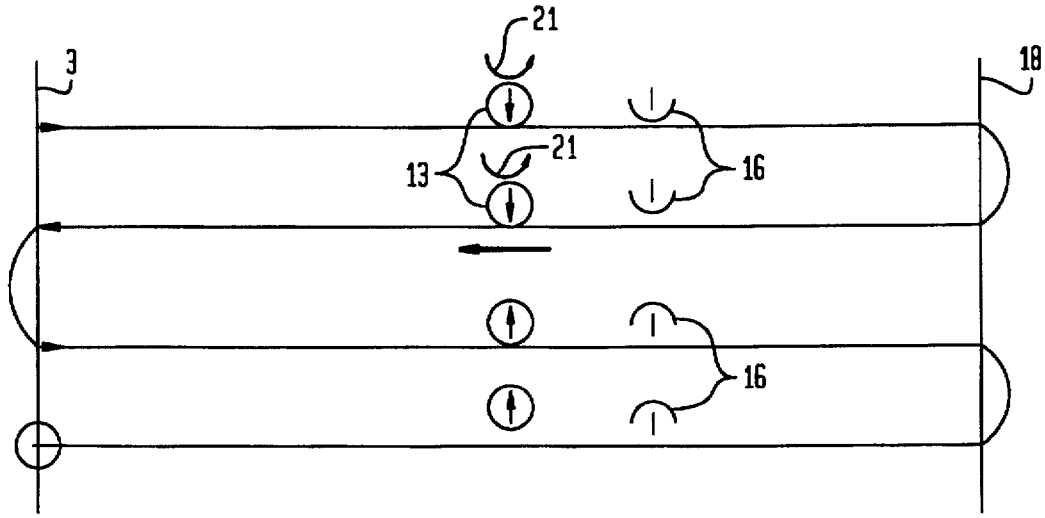

The program sequence according to FIG. 4 effects a priming and color coating of the workpiece 2. During the first forward run, the workpiece 2 is conveyed from the table 3 at the lower speed and coated in the station 12 with a varnish paint. The dryer 16 is idle. The return run is effected at the lower speed, with the dryer 16 being idle while the station 12 applies a second coat of paint upon the workpiece 2. As indicated by arrow 21, in the first cycle the rotational direction of the applicator drum 13 in the station 12 opposes the conveying direction of the workpiece 2 during application of the coat of paint. The second cycle is also run at lower speed, with only the dryer 16 being operational to effect the drying process. The end product can be removed from the apparatus 1 at the receiving end 3.

Figure 5:
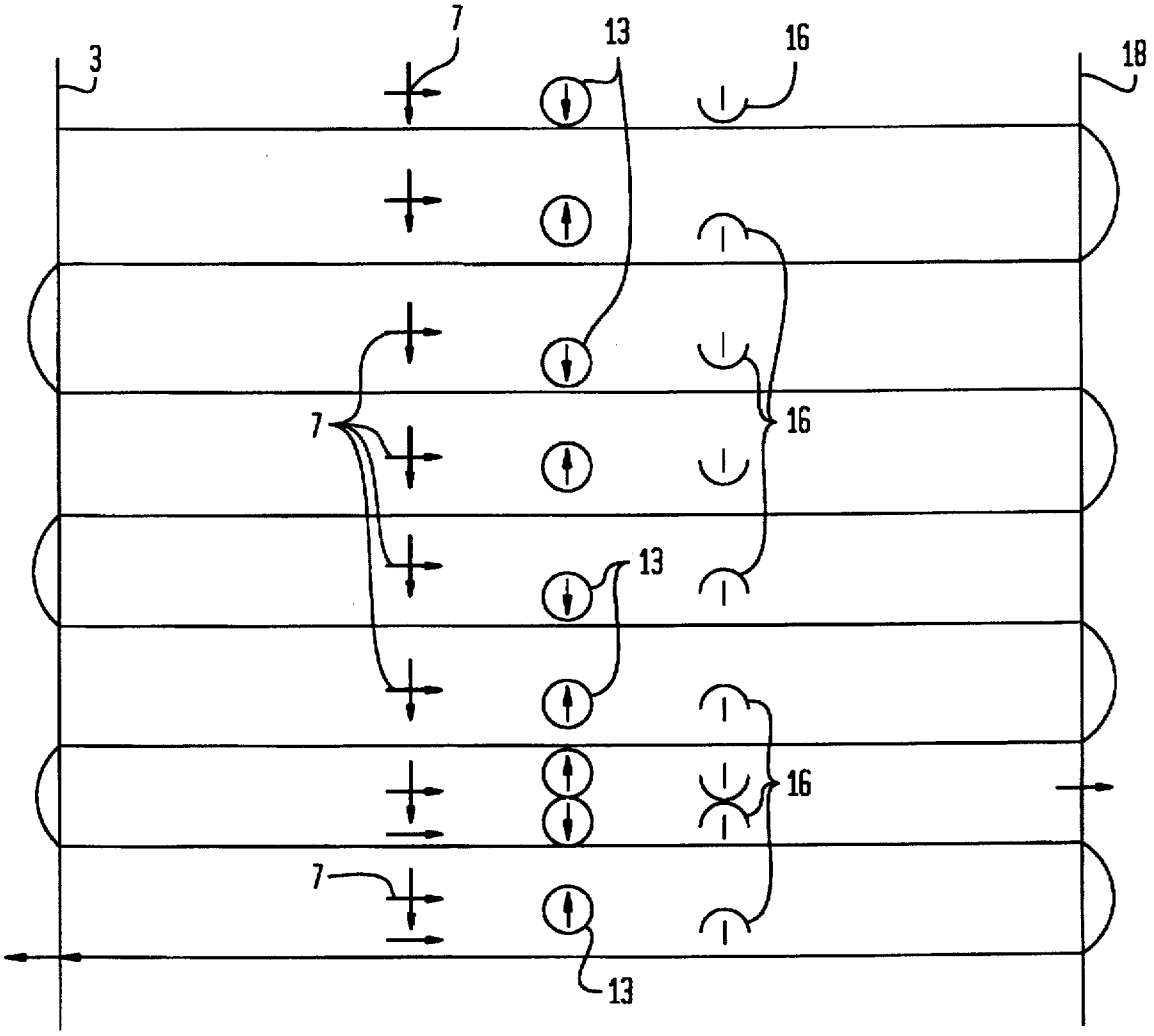
Figure 6A:
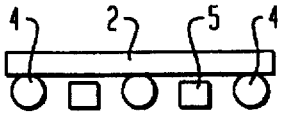
FIGS. 6.1 to 6.4 show schematic illustrations of various positions of a lifting device for use in the apparatus according to the present invention.
Figure 6B:
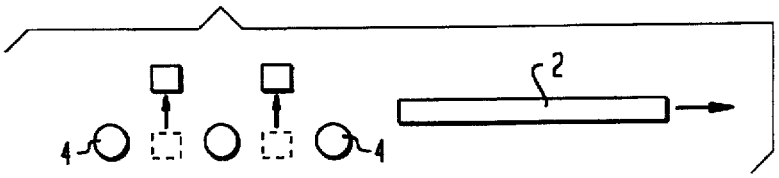
Figure 6C:
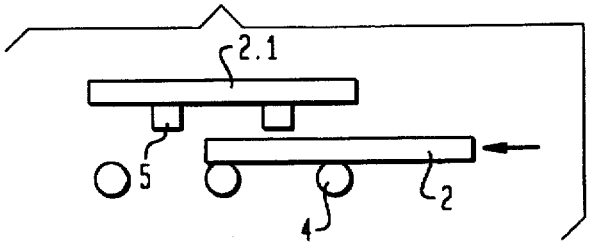
Figure 6D:
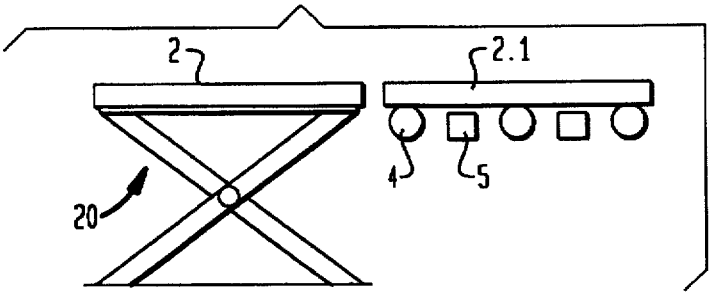

FIG. 5 shows a program sequence in which the grinder 11 of the grinding unit 7 is utilized.

Transferred to the receiving table 3 is a workpiece made of wood which is transported during the first forward run at lower speed and machined in the first stage by the grinding unit 7. Subsequently, the station 12 applies a first coat of paint. The dryer 16 is idle. When the workpiece 2 reaches table 18, the control unit 19 reverses the conveying direction and increases the conveying speed of the conveyor tables 17, 6, 14, 8 and 4, with the dryer 16 being operational to intensify the drying action. The second cycle is run with the grinding station 7 and the dryer 16 being idle and with the coating station 12 applying a second coat of paint during the forward run at the lower speed. The return run is executed at a higher speed whereby also station 12 is idle. The third forward run is executed with idle grinding unit 7 while the station 12 applies a third coat of paint. Also the dryer 16 is on to intensify the drying action of the applied coat of paint. This drying process is continued by the subsequent return run during which the workpiece 2 is conveyed at lower speed, with the station 12 and the grinding unit 7 being idle.

After concluding the next forward run, the workpiece 2 may already be an end product and removed from the discharge table 18 whereby all stations 7, 12, 16 are idle. However, if further treatment of the workpiece 2 is desired, e.g. grinding, application of a further coat of paint and drying of the paint, the following forward run is executed at a lower speed. During return run, the dryer 16 is on to continue and intensify the drying action while the workpiece 2 is conveyed at a lower speed while the coating station 12 and the grinding unit 7 are idle. The end product can then be removed the apparatus 1 at the receiving end 3.

As the workpiece 2 shuttles back and forth though the various stations of the apparatus according to the invention, it can be coated during forward and return runs with varying amounts of paint so that a targeted layer thickness of the applied coats can be selected.

The provision of the lifting device in form of spikes 5 allows a most economical operation of the apparatus 1 because a workpiece 2.1 can be readied while the workpiece 2 shuttles through the apparatus. As stated above and shown in FIGS. 6.1 to 6.4, when a workpiece 2 is placed on the receiving end 3 and advanced towards the first station, the spikes 5 are moved to the upper position, as shown in FIG. 6.2. In this position, the spikes 5 can receive the second workpiece 2.1 while the first workpiece 2 shuttles back and forth through the various stations. Since the workpiece 2.1 is received by the spikes 5 at the elevated position, the workpiece 2 can move underneath the spikes 5, as shown in FIG. 6.3, for removal and transfer to another processing unit or for return to the various stations. Once the workpiece is removed from the apparatus 1 and transferred to the neighboring table 20, as shown in FIG. 6.4, the spikes 5 of the lifting device are lowered to the position between the rollers 4. The workpiece 2.1 is received by the table 3 and advanced by the rollers 4 in direction towards the stations.

While the invention has been illustrated and described as embodied in an apparatus for color coating and further manipulating workpieces, it is not intended to be limited to the details shown since various modifications and structural changes may be made without departing in any way from the spirit of the present invention.

What is claimed as new and desired to be protected by Letters Patent is set forth in the appended claims:

1. Apparatus for color coating and manipulating a workpiece of wood plastic material or metal; comprising:

a coating means for applying a coat of paint onto a workplace;

at least one further treatment unit positioned upstream or downstream of said coating means for treating the workpiece;

conveyor means for shuttling the workpiece through said coating means and said treatment unit at least in one forward run and at least in one return run in a single operative plane, said conveyor means including a table equipped with driven rollers;

control means for operating said coating means said treatment unit and said conveyor means commensurate with a preselected program between an operational position and an idle position during shuttling of the workpiece; and a lifting unit positioned upstream of the coating means for movement of a workplace to be treated from an upper idle position to a disposition upon said table, said lifting unit being constructed in form of spikes that are vertically adjustable in unison for movement between a lower position in which the spikes are positioned between roller of said table and an upper position for receiving the workpiece.

2. The apparatus of claim 1 wherein said conveyor means shuttles the workpiece between a receiving end and a discharge end, with the receiving end and the discharge end coinciding with each other.

3. The apparatus of claim 1 wherein said conveyor means includes a plurality of such tables, each said coating means and said treatment unit including a separate such table, whereby said tables extend in alignment with each other.

4. The apparatus of claim 3 wherein said conveyor means shuttles the workpiece from a receiving end to a discharge end, one such table being positioned at the receiving end and another such table positioned at the discharge end.

5. The apparatus of claim 1 wherein the workpiece is moveable underneath the spikes of said lifting unit when the spikes occupy the upper position.

6. The apparatus of claim 1 wherein said treatment unit includes a machining unit positioned upstream of the coating means for cutting the workpiece, said control means moving said machining unit between an operating position and an idle position.

7. The apparatus of claim 1 wherein said control means operates said conveyor means in unison at variable speeds to adjust the speed of the workpiece during forward run and return run.

8. The apparatus of claim 1 wherein said coating means applies a coat of paint upon the workpiece at a quantity that is selectable by the number of forward and return runs.

9. The apparatus of claim 1 wherein said treatment unit includes a dryer positioned downstream of the coating means, said control means moving said dryer between an operating position and an idle position.

10. Apparatus for color coating and manipulating a workpiece of wood, plastic material or metal; comprising:

a coating means for applying a coat of paint onto a workpiece;

at least one further treatment unit positioned upstream or downstream of said coating means for treating the workpiece, said treatment unit includes a machining unit positioned upstream of the coating means for cutting the workpiece;

conveyor means for shuttling the workpiece through said coating means and said treatment unit at least in one forward run and at least in one return run in a single operative plane; and control means for operating said coating means, said treatment unit and said conveyor means commensurate with e preselected program between an operational position and an idle position during shuttling of the workpiece, and for moving said machining unit between an operating position and an idle position.

11. The apparatus of claim 10 wherein said conveyor means shuttles the workpiece between a receiving end and a discharge end, with the receiving end and the discharge end coinciding with each other.

12. The apparatus of claim 11 wherein said conveyor means includes a plurality of single tables equipped with driven rollers, each said coating means and said treatment unit including a separate such table, whereby said tables extend in alignment with each other.

13. The apparatus of claim 12 wherein said conveyor means shuttles the workplace from a receiving end to a discharge end, one such table being positioned at the receiving end and another such table positioned at the discharge end.

14. The apparatus of claim 4, further comprising a lifting unit positioned upstream of the coating station adjacent said one table of said conveyor means for movement of a workpiece to be treated from an upper idle position to a disposition upon said one table, said lifting unit being constructed in form of spikes that are vertically adjustable in unison for movement between a lower position in which the spikes are positioned between rollers of said one table and an upper position for receiving the workpiece.

15. The apparatus of claim 14 wherein the workplace is moveable underneath the spikes of said lifting unit when the spikes occupy the upper position.

16. The apparatus of claim 10 wherein said control means operates said conveyor means in unison at variable speeds to adjust the speed of the workpiece during forward run and return run.

17. The apparatus of claim 10 wherein said coating means applies a coat of paint upon the workpiece at a quantity that is selectable by the number of forward and return runs.

18. The apparatus of claim 10 wherein said treatment unit includes a dryer positioned downstream of the coating means, said control means moving said dryer between an operating position and an idle position.

19. Apparatus for color coating and manipulating a workpiece of wood, plastic material or metal; comprising:

a coating means for applying a coat of paint onto a workpiece;

at least one further treatment unit positioned upstream or downstream of said coating means for treating the workpiece;

conveyor means for shuttling the workpiece through said coating means and said treatment unit at least in one forward run and at least in one return run in a single operative plane; and control means for operating said coating means, said treatment unit and said conveyor means commensurate with a preselected program between an operational position and an idle position during shuttling of the workplace, wherein said coating means applies a coat of paint upon the workpiece at a quantity that is selectable by the number of forward and return runs.

20. The apparatus of claim 19 wherein said conveyor means shuffles the workpiece between a receiving end and a discharge end, with the receiving end and the discharge end coinciding with each other.

21. The apparatus of claim 20 wherein said conveyor means includes a plurality of single tables equipped with driven rollers, each said coating means and said treatment unit including a separate such table, whereby said tables extend in alignment with each other.

22. The apparatus of claim 21 wherein said conveyor means shuttles the workplace from e receiving end to a discharge end, one such table being positioned at the receiving end and another such table positioned at the discharge end.

23. The apparatus of claim 22, further comprising a lifting unit positioned upstream of the coating station adjacent said one table of said conveyor means for movement of a workplace to be treated from an upper idle position to a disposition upon said one table, said lifting unit being constructed in form of spikes that are vertically adjustable in unison for movement between a lower position in which the spikes are positioned between rollers of said one table and an upper position for receiving the workpiece.

24. The apparatus of claim 23 wherein the workpiece is moveable underneath the spikes of said lifting unit when the spikes occupy the upper position.

25. The apparatus of claim 19 wherein said control means operates said conveyor means in unison at variable speeds to adjust the speed of the workplace during forward run and return run.

26. The apparatus of claim 19 wherein said treatment unit includes a dryer positioned downstream of the coating means, said control means moving said dryer between an operating position and an idle position.

* * * * *

UNITED STATES PATENT AND TRADEMARK OFFICE

CERTIFICATE OF CORRECTION

PATENT NO. :5,672,207

DATED :September 30, 1997

INVENTOR(S) :HORST-DIETER OECHLER

It is certified that error appears in the above-identified patent and that said Letters Patent is hereby corrected as shown below:

Claim 1, column 5, line 57, change "workplace" to --workpiece--;

Claim 1, column 6, line 5, change "workplace" to --workpiece--;

Claim 1, column 6, line 9, change "roller" to --rollers;

Claim 10, column 6, line 58, change "e preselected" to -- a preselected--;

Claim 14, column 7, line 9, change " of claim 4" to --of claim 13--;

Claim 15, column 7, line 18, change "workplace" to --workpiece--;

Claim 22, column 8, line 18, change "e receiving end" to -- a receiving end--.

Claim 22, column 18, line 18, change "workplace" to --workpiece--.

Signed and Sealed this

Fourteenth Day of April, 1998

Bruce Lehman

*Attest:*

BRUCE LEHMAN

*Attesting Officer*

*Commissioner of Patents and Trademarks*